US007184559B2

(12) United States Patent
Jouppi

(10) Patent No.: US 7,184,559 B2
(45) Date of Patent: Feb. 27, 2007

(54) SYSTEM AND METHOD FOR AUDIO TELEPRESENCE

(75) Inventor: Norman P. Jouppi, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1008 days.

(21) Appl. No.: 09/792,489

(22) Filed: Feb. 23, 2001

(65) Prior Publication Data

US 2002/0141595 A1 Oct. 3, 2002

(51) Int. Cl.
*H04R 3/00* (2006.01)

(52) U.S. Cl. ..... 381/92; 379/202.01; 348/14.07; 348/14.08

(58) Field of Classification Search ..... 381/92, 381/17; 379/202.01, 206.01; 348/14
See application file for complete search history.

(56) References Cited

U.S. PATENT DOCUMENTS 4,712,231 A * 12/1987 Julstrom ..... 379/202.01
5,020,098 A * 5/1991 Celli ..... 379/202.01
5,335,011 A * 8/1994 Addeo et al. ..... 379/206.01
5,434,912 A * 7/1995 Boyer et al. ..... 379/202.01
5,808,663 A * 9/1998 Okaya ..... 348/14.1
5,889,843 A * 3/1999 Singer et al. ..... 379/202.01
6,125,115 A * 9/2000 Smits ..... 381/17
6,169,806 B1 * 1/2001 Kimura et al. ..... 381/17
6,507,658 B1 * 1/2003 Abel et al. ..... 381/17
6,583,808 B2 * 6/2003 Boulanger et al. ..... 348/14.09
6,992,702 B1 * 1/2006 Foote et al. ..... 348/211.8
2002/0067405 A1 * 6/2002 McDiarmid ..... 348/14.08
2003/0081115 A1 * 5/2003 Curry et al. ..... 348/14.12

FOREIGN PATENT DOCUMENTS

WO WO 9858523 A1 * 12/1998

* cited by examiner

*Primary Examiner*—Brian T. Pendleton

(57) ABSTRACT

A system and method for audio telepresence. The system includes a user station and a telepresence unit. The telepresence unit includes a directional microphone for capturing sounds at the remote location, and means for converting the captured sounds into a stream of data to be communicated to the user station. The user station includes means for receiving the stream of data and a plurality of speakers for recreating the sounds of the remote location. The user station and the speakers are located within an anechoic chamber where sound reflections are substantially absorbed by anechoic linings of the chamber walls. Because of the substantial lack of sound reflection within the anechoic chamber, a user within the anechoic chamber will be able to experience an aural ambience that closely resembles the sounds captured at the remote location. The user station may include microphones for capturing the user's voice, and the telepresence unit may include speakers for projecting the user's voice at the remote location. Feedback suppression, audio direction steering, and head-coding techniques may also be used to enhance the user's sense of remote presence.

25 Claims, 11 Drawing Sheets

SYSTEM AND METHOD FOR AUDIO TELEPRESENCE

BRIEF DESCRIPTION OF THE INVENTION

The present invention relates to the field of telepresence. More specifically, the present invention relates to a system and method for audio telepresence.

BACKGROUND OF THE INVENTION

The goals of a telepresence system is to create a simulated representation of a remote location to a user such that the user feels he or she is actually present at the remote location, and to create a simulated representation of the user at the remote location. The goal of a real-time telepresence system to is to create such a simulated representation in real time. That is, the simulated representation is created for the user while the telepresence device is capturing images and sounds at the remote location. The overall experience for the user of a telepresence system is similar to video-conferencing, except that the user of the telepresence system is able to remotely change the viewpoint of the video capturing device.

Most research efforts in the field of telepresence to date have focused on the role of the human visual system and the recreation of a visually compelling ambience of remote locations. The human aural system and the techniques for recreating the aural ambience of remote locations, on the other hand, have been largely ignored. The lack of a system and method for recreating the aural ambience of remote locations can significantly diminish the immersiveness of the telepresence experience.

Accordingly, there exists a need for a system and method for audio telepresence.

SUMMARY OF THE DISCLOSURE

An embodiment of the present invention provides a system for recreating an aural ambience of a remote location for a user at a local location. In order to recreate the aural ambience of a remote location, the present invention provides a system that: (1) preserves the directional characteristics of the audio stimuli, (2) overcomes the issue of reflection from ambient surfaces, (3) prevents unwanted disturbance and noise from the user's location, and (4) prevents feedback from the user's location to the remote location and back through a remote microphone to speakers at the user's site.

According to one aspect of the invention, the system includes a user station located at a first location and a remote telepresence unit located at a second location. The remote telepresence unit includes a plurality of directional microphones for acquiring sounds at the second location. The user station, which is coupled to the remote telepresence unit via a communications medium, includes a plurality of speakers for recreating the sounds acquired by the remote telepresence unit. The speakers are positioned to surround the user such that the directional characteristics of the audio stimuli can be preserved. Preferably, the user station and the speakers are located within a substantially echo-free and noise-free environment. The substantially echo-free and noise-free environment can be created by playing the user station within a chamber and by lining the chamber walls with substantially anechoic materials and substantially soundproof materials.

In one embodiment, the user station includes microphones for capturing the user's voice. The user's voice is then transmitted to the remote telepresence unit to be projected via a plurality of speakers. Techniques such as head-coding and audio direction steering may be used to further enhance a user's telepresence experience.

BRIEF DESCRIPTION OF THE DRAWINGS

For a better understanding of the invention, reference should be made to the following detailed description taken in conjunction with the accompanying drawings, in which.

DETAILED DESCRIPTION

Overview of the Present Invention

Figure 1:
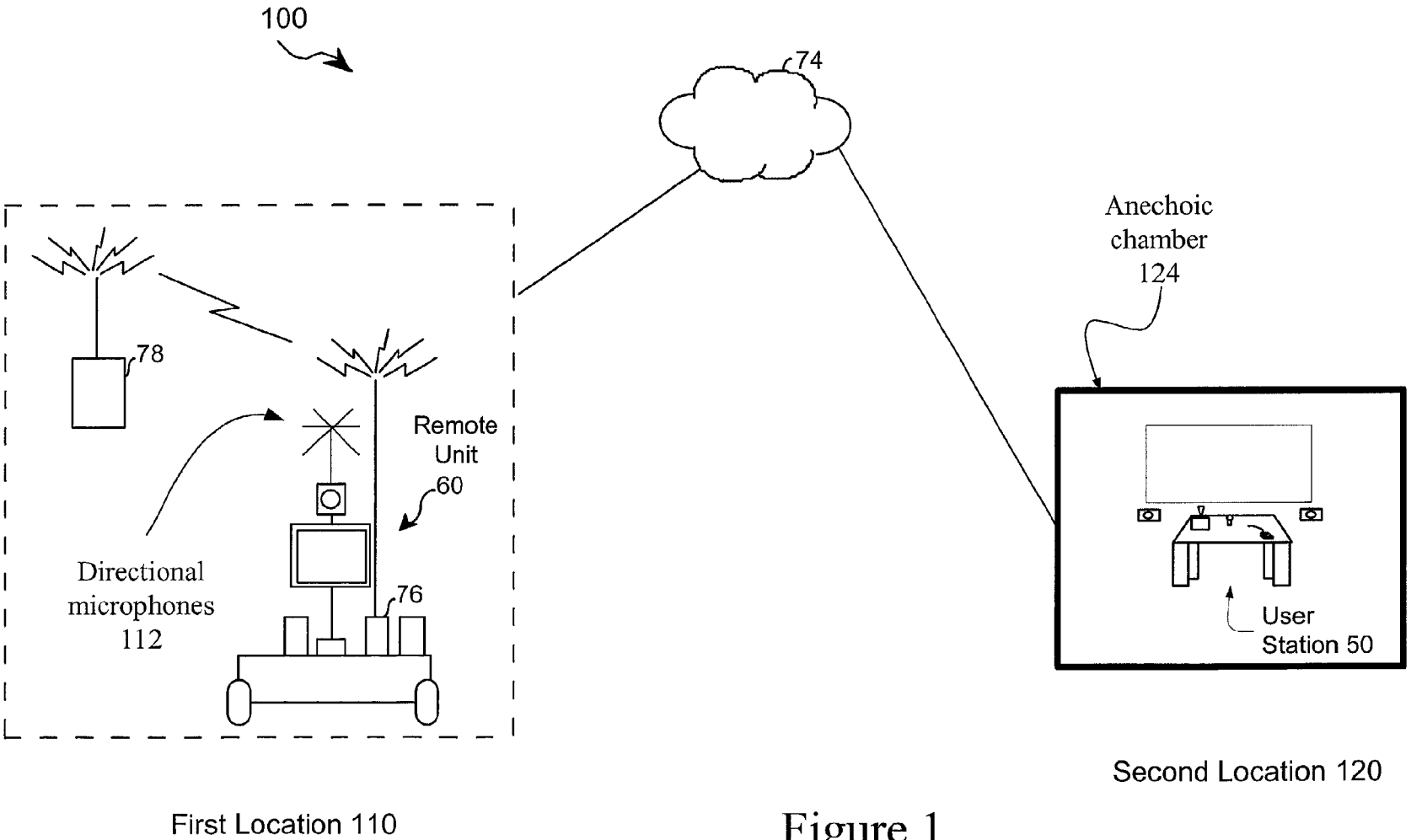
FIG. 1 depicts a telepresence system in accordance with an embodiment of the present invention.

FIG. 1 depicts a telepresence system 100 in accordance with an embodiment of the present invention. As shown, the telepresence system 100 includes a remote telepresence unit 60 at first location 110, and a user station 50 at a second location 120. The user station 50 is responsive to a user and communicates information to and receives information from the user. The remote telepresence unit 60, responsive to commands from the user, captures video and audio information at the first location 110 and communicates the acquired information back to the user station 50. The user station 50 includes a number of speakers for rendering audio information communicated to the user station 50, and a number of microphones for acquiring the user's voice for reproduction at the first location 110. The user station 50 may also include a screen for rendering video information communicated to the user station 50. In essence, the remote telepresence unit 60 acts as remote-controlled "eyes," "ears," and "mouth" of the user.

In the embodiment shown in FIG. 1, the user station 50 has a communications interface to a communications medium 74. In one embodiment, the communications medium 74 is a public network such as the Internet. Alternately, the communications medium 74 includes a private network, or a combination of public and private networks. The remote telepresence unit 60 is coupled to the communications medium 74 via a wireless transmitter/receiver 76 on the remote telepresence unit 60 and at least one corresponding wireless transmitter/receiver base station 78 that is placed sufficiently near the remote telepresence unit 60.

One goal of the telepresence system 100 is to create a visual sense of remote presence for the user. Another goal of the telepresence system 100 is to provide a three-dimensional representation of the user at the second location 120. Systems and methods for creating a visual sense of remote presence and for providing a three-dimensional representation of the user are described in co-pending application Ser. No. 09/315,759, entitled "Robotic Telepresence System."

Yet another goal of the telepresence system 100 is to create an aural sense of remote presence for a user. In order to achieve this goal, at least four objectives should be accomplished. First, the positional information of the audio stimuli at the first location 110 should be captured. Second, the audio stimuli should be recreated as closely as possible at the second location 120 unless the user desires otherwise. Third, noises generated at the second location 120 should be kept to a minimum. And, fourth, feedback between the first location 110 and the second location 120 should be suppressed.

Accordingly, the remote telepresence unit 60 of the present invention uses directional sound capturing devices to capture the audio stimuli at the first location 110. Signals from the directional sound capturing devices are converted, processed, and then transmitted through communications medium 74 to the user station 50. The audio stimuli acquired by the remote telepresence unit 60 are recreated at the user station 50. Sound reflections are minimized by the placing the user station 50 within a substantially echo-free chamber 124. The chamber 124 also has sound barriers to prevent transmission of 15 unwanted external sounds into the chamber. Feedback suppression techniques are used to prevent echos from circling between the first location 110 and the second location 120.

By preserving both the directionality and reflection profile of the remote sound field, the telepresence system 100 can recreate the remote sound field at the second location 120. A user within the recreated sound field will be able to experience an aural sense of remote presence.

As mentioned, the first objective of the present invention is to capture positional information of audio stimuli at the first location 110. In one embodiment, the remote telepresence unit 60 uses a directional microphone to capture the remote sound field. A number of different directional microphone arrangements are possible. In one implementation, a set of shotgun microphones are used. Shotgun microphones are well known in the art to be highly directional. An example of a highly directional microphone is the MKE-300, manufactured by Sennheiser electronic KG of Germany. Because shotgun microphones have a minor pick-up lobe out their rear, an even number of microphones, with microphones in pairs facing opposite directions, are used. In another embodiment, a phased array of microphones may be used. Phased-arrays require more processing power to produce the distinct audio channels, but they are more flexible and more precise than shotgun microphones. A phased-array would be required for practical implementation of simultaneous vertical directionality as well as horizontal directionality. A combination of phased-arrays and shotgun microphones may also be used.

In one embodiment, one shotgun microphone is used for each separate audio channel. In another embodiment, one shotgun microphone may be used for multiple audio channels. For example, the output of four shotgun microphones can be processed by the remote telepresence unit 60 to derive signals for eight speaker channels.

The second objective of the present invention is to recreate the remote sound field as closely as possible by preserving the directional and reflection profiles of the audio stimuli. Humans can quite accurately determine the position of an audio stimuli in the horizontal plane, and can also do so in the vertical plane with less precision. This can be simulated by a stereo-like effect, where a sound is mixed in varying proportions between two audio channels and is output to different speaker channels. But if the speakers subtend an angle of more than sixty degrees, sound intended to come from near the center of a pair of speakers can appear muddy and indistinct. Accordingly, in order to avoid generating muddy and indistinct sounds, one embodiment of the present invention uses at least six speakers at the user station 50. More specifically, six or more speakers are placed around the user in a horizontal plane to reproduce sound coming from different directions. The speakers may be split into two stacked rings of speakers if reproduction of vertical sound directionality is desired. Each ring may have at least six speakers in the horizontal plane.

It may not be possible to recreate the remote sound field if sound reflections at the user station 50 are not properly controlled. Depending on the size and type of furnishings in a room, sounds created in different rooms will sound differently. For example, sounds produced in a small room with hard surface walls, ceilings, and floors will echo quickly around the room for a long time. This will cause the sound to decay slowly. In contrast, sounds produced in a very large open hall encounter very few immediate reflections. Additionally, reflections in a large open hall tend to be significantly separated from the initial sound. If the first location 110 is large room with few hard surfaces and if the user station 50 is located in a small room with many hard surfaces, the sound field created at the second location 120 may not closely resemble that of the first location 110.

Accordingly, sound reflections at the second location 120 are minimized by using an anechoic chamber to accommodate the user station 50. An anechoic chamber herein refers to an environment where sound reflections are reduced. An anechoic chamber can be constructed by lining the walls of a room with anechoic materials, such as anechoic foams. Anechoic materials are well known in the art. Note that anechoic materials do not absorb sound reflections perfectly. The objective of recreating the aural ambience of a remote location is achieved as long as local sound reflections are substantially reduced.

The third objective of the present invention is to minimize disturbance at the second location 120. This can be accomplished by moving noise sources (e.g., computers) outside the anechoic chamber. Commercially-available sound barriers may also be applied to the walls and ceilings before application of the anechoic foams to prevent external local sounds from interfering with the user's sense of remote presence.

The fourth objective of the present invention is to suppress audio feedback between the first location 110 and the second location 120. In one embodiment, audio feedback between the first location 110 and the second location 120 is suppressed by reducing the gain of the microphone in proportion to the strength of the signal driving the speakers at the corresponding location. This feedback suppression technique will be described in greater detail below.

User Station

Figure 2:
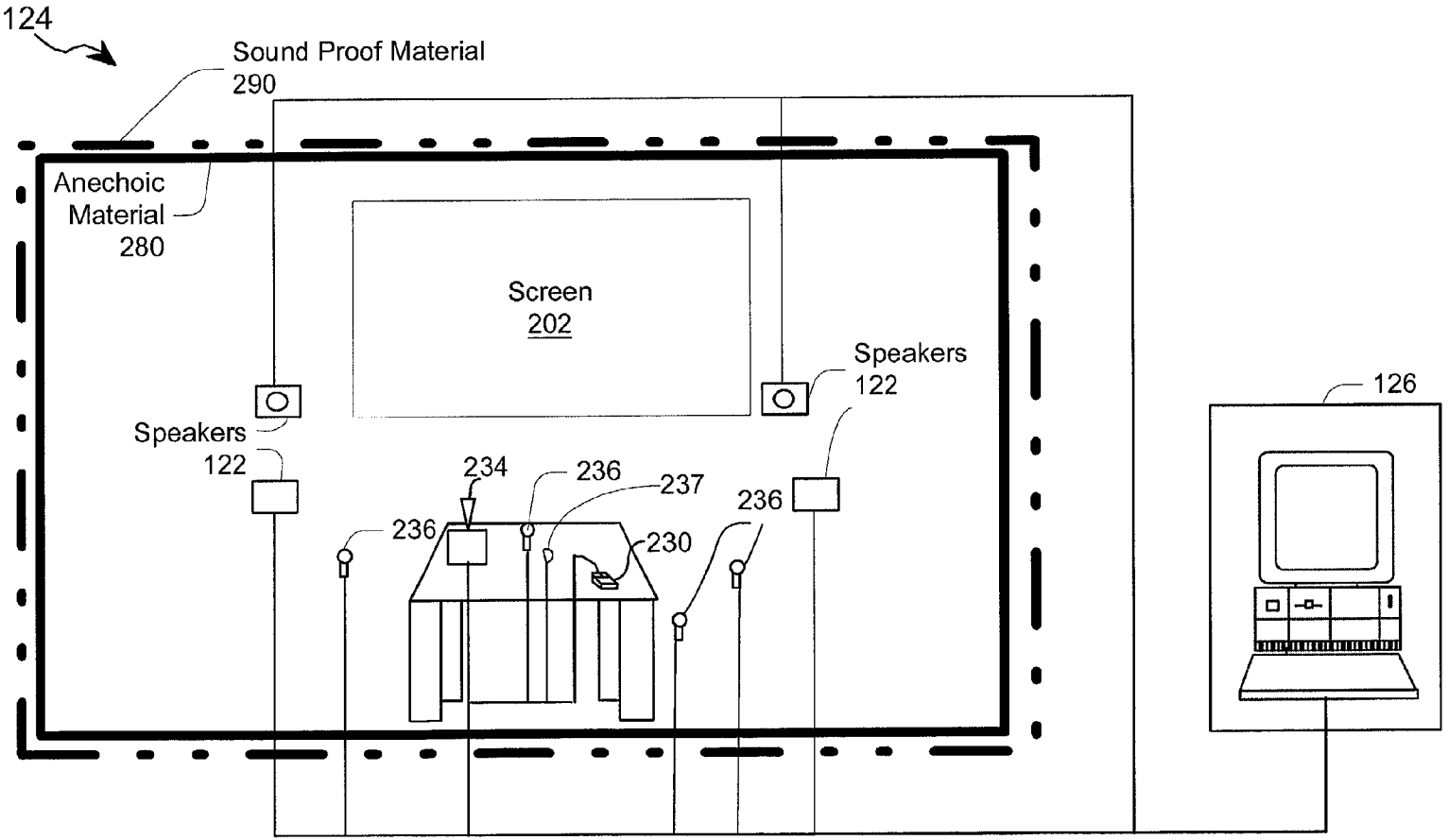
FIG. 2 depicts a user station in accordance with an embodiment of the present invention.

FIG. 2 depicts a user station 50 in accordance with an embodiment of the present invention. As shown, the user station 50 is located within an anechoic chamber 124 whose walls are lined with an anechoic material 280 such that local sound reflections are reduced. The walls of the anechoic chamber 124 are also lined with a substantially sound-proof material 290 to reduce external disturbance. The user sits at the user station 50 and is surrounded by speakers 122. In the present embodiment, there are a total of six speakers 122 that surround the user. As discussed earlier, at least six speakers are used such that each speaker subtend an angle of at most sixty degrees for optimum sound field recreation. Furthermore, the speakers 122 are placed around the user in a horizontal plane to reproduce sound coming from different directions. The speakers 122 are driven by a computer system 126, which is located outside the chamber 124, to reproduce audio stimuli captured by the remote telepresence unit 60.

At the user station 50, the user may use a mouse 230 to control the remote telepresence unit 60 at the first location 110. The user station 50 has a plurality of microphones 236 and at least one lapel microphone 237 coupled to the computer 126 for acquiring the user's voice for reproduction at the first location 110. The shotgun microphones 236 are preferably Audio-Technica model AT815 microphones. The lapel microphone 237 is preferably implemented with an Azden WL/T-Pro belt-pack VHF transmitter and an Azden WDR-PRO VHF receiver.

With reference still to FIG. 2, the user station 50 has a joystick control unit 234 for allowing the user to "steer" the user's hearing in a particular direction. Sound steering is discussed in more details below. Also illustrated is an optional screen 202 for rendering video images captured by the remote telepresence unit 60. In one implementation, the screen 202 may be a panoramic screen to provide a more immersive telepresence experience to the user. Furthermore, in an embodiment where the remote telepresence unit 60 is mobile, another joystick control unit may be provided for controlling the movement of the unit 60.

Remote Telepresence Unit

Figure 3:
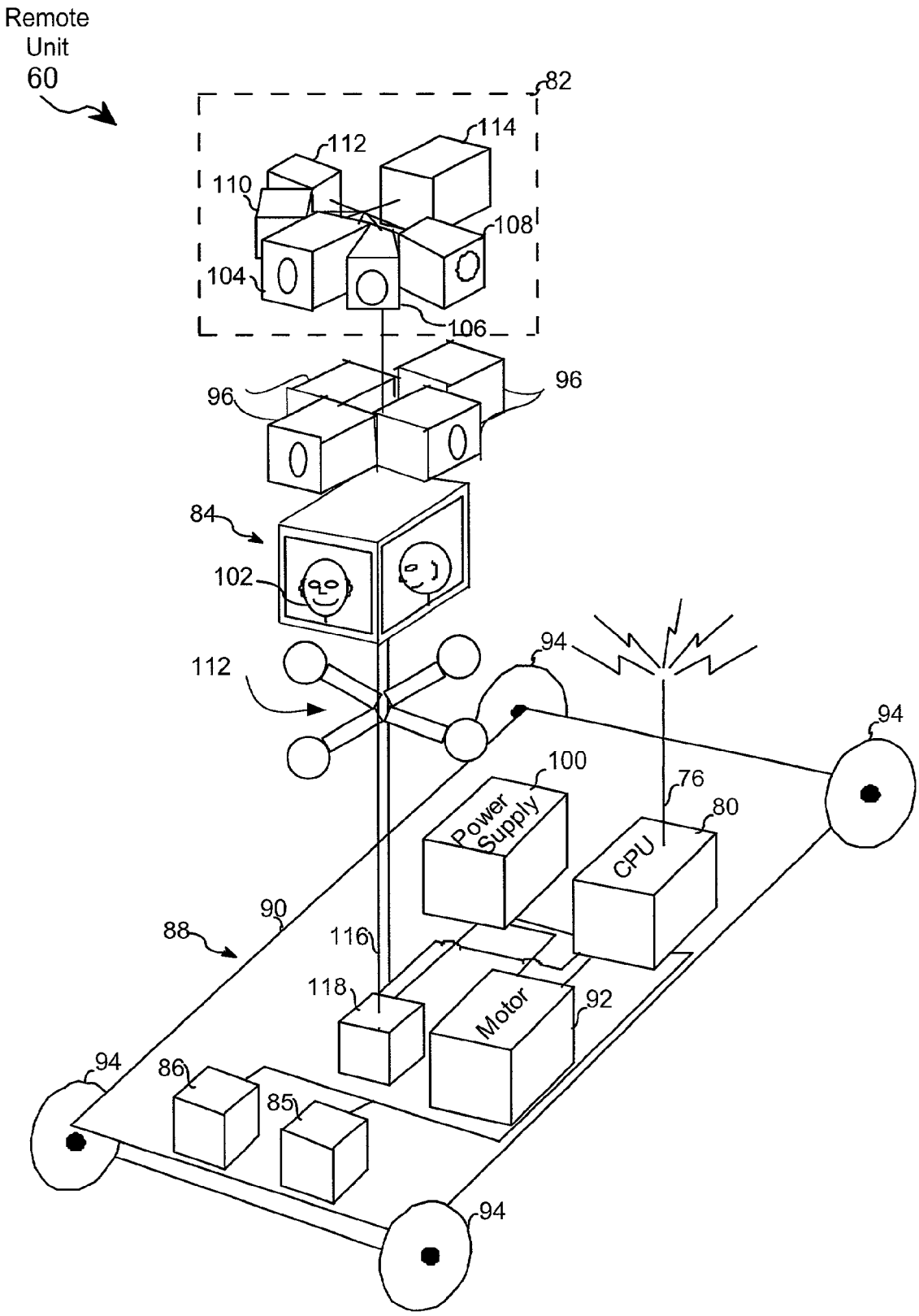
FIG. 3 depicts a telepresence unit according to an embodiment of the present invention.

FIG. 3 depicts a remote telepresence unit 60 according to an embodiment of the present invention. As shown in FIG. 3, on the remote telepresence unit 60, a control computer (CPU) 80 is coupled to and controls a camera array 82, a display 84, at least one distance sensor 85, an accelerometer 86, the wireless computer transmitter/receiver 76, and a motorized assembly 88. The motorized assembly 88 includes a platform 90 with a motor 92 that is coupled to wheels 94. The control computer 80 is also coupled to and controls speakers 96 and directional microphones 112. The platform 90 supports a power supply 100 including batteries for supplying power to the control computer 80, the motor 92, the display 84 and the camera array 82.

The remote telepresence unit 60 captures video and audio information by using the camera array 82 and the directional microphones 112. Video and audio information captured by the remote telepresence unit 60 is processed by the CPU 80, and transmitted to the user station 50 via the base station 78 and communications network 74. Sounds acquired by the microphones 236 at the user station 50 are reproduced by the speakers 96. The user's image may be captured by one or more cameras at the user station 50 and displayed on the display 84 to allow human-like interactions between the remote telepresence unit 60 and the people around it.

Local and Remote Computer Systems

Figure 4:
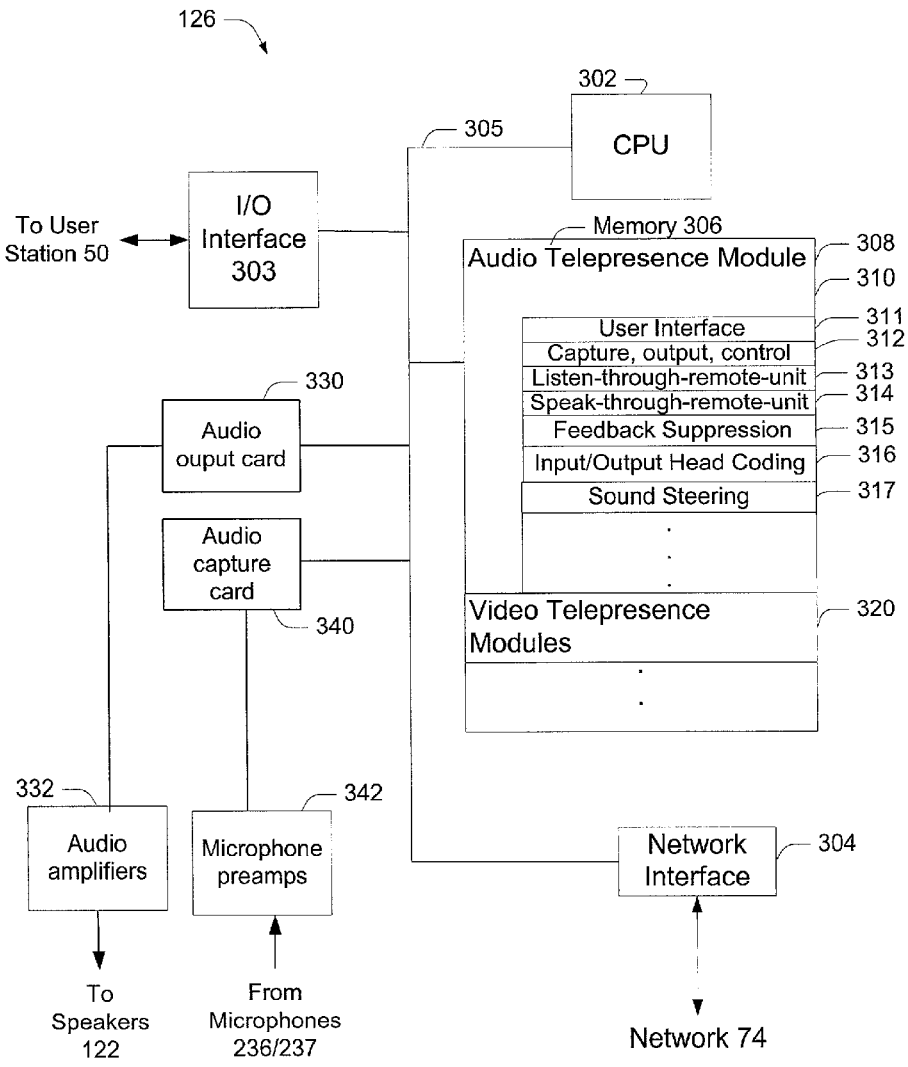
FIG. 4 is a block diagram illustrating the components of the local computer system 126 in accordance with an embodiment of the present invention.

FIG. 4 is a block diagram illustrating the components of the local computer system 126 in accordance with an embodiment of the present invention. As shown, local computer system 126 includes a central processing unit (CPU) 302, a user input/output (I/O) interface 303 for coupling user station 50, a network interface 304 for coupling to network 74, a system memory 306 (which may include random access memory as well as disk storage and other storage media), an audio output card 330, an audio capture card 340 and one or more buses 305 for interconnecting the aforementioned elements of system 126. Local computer system 126 also includes audio amplifiers 332 that are coupled to audio output card 330, and microphone pre-amps 342 that are coupled to audio capture card 340. The audio amplifiers 332 are for coupling to speakers 122, and the microphone pre-amps are for coupling to microphones 236 and lapel microphone 237.

Components of the computer system 80 of the remote telepresence unit 60 are similar to those of the illustrated system, except that the microphone pre-amps of the remote computer system 80 are configured for coupling to directional microphones 112, and that the audio amplifiers are configured for coupling to speakers 96.

Operations of the local computer system 126 are controlled primarily by control programs that are executed by the unit's central processing unit 302. In a typical implementation, the programs and data structures stored in the system memory 306 will include:

- an operating system 308 (such as Solaris, Linux, or WindowsNT) that includes procedures for handling various basic system services and for performing hardware dependent tasks;
- audio telepresence software module 310; and
- video telepresence software module 320.

The video telepresence software module 320, which is optional, may include send and receive video modules, foveal video procedures, anamorphic video procedures, etc. These and other components of the video telepresence software module 320 are described in detail in co-pending U.S. patent application Ser. No. 09/315,759. Additional modules for controlling the remote telepresence unit 60, which are described in detail in the co-pending patent application entitled "Robotic Telepresence System," are not illustrated herein.

The components of the audio telepresence software module 310 that reside in memory 306 of the local computer system 126 preferably include the following:

- a user interface module 311 for receiving user commands via the user interface 303 and for translating the user commands into machine-readable form,
- an audio capturing and rendering module 312 for processing data to be provided to the audio output card 330 and for processing data received by the audio capture card 340,
- a listen-via-remote telepresence unit module 313;
- a speak-via-remote telepresence unit module 314,
- feedback suppression module 315,
- input/output head coding module 316, and
- sound steering module 317.

Operations and functions of the listen-via-remote telepresence unit module 313, the speak-via-remote telepresence unit module 314, the feedback suppression module 315, the input/output head coding module 316 and the sound steering module 317 will be described in greater details below.

Listen Through Remote Telepresence Unit Procedure

Figure 5A:
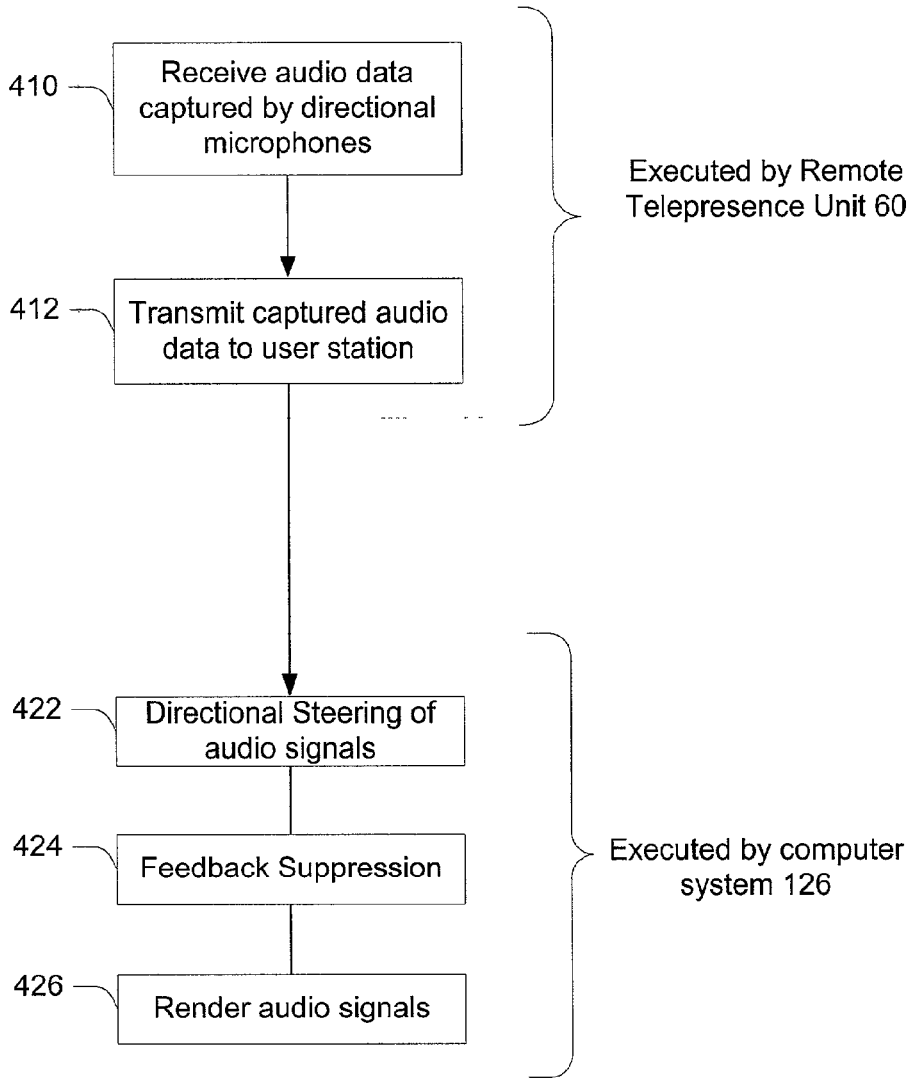
FIG. 5A is a flow diagram illustrating steps of a listen-via-remote-unit procedure in accordance with an embodiment of the present invention.

FIG. 5A is a flow diagram illustrating steps of a listen-via-remote-unit procedure in accordance with an embodiment of the present invention. In one embodiment, steps 410, 412 are executed by the CPU 80 of the remote telepresence unit 60 under the control of the listen-via-remote telepresence unit module 313. Steps 420, 422, 424 are executed by the local computer system 126 under the control of the listen-via-remote telepresence unit module 313. In step 410, the remote telepresence unit 60 receives audio data acquired by the directional microphones 112. In the present embodiment, four channels of audio data each representing a different direction of sound sources are captured. In step 412, the captured audio channels are converted into data packets for transmission to the local computer system 126 via communications medium 74.

In step 422, upon receiving the audio data from the remote telepresence unit 60, the local computer system 126 executes the sound steering module 317. The sound steering procedure allows the user to "steer" his or her hearing to one particular direction by adjusting the relative loudness of the audio channels. The sound steering procedure is described in more detail below.

In step 424, the feedback suppression module 317 is executed. The feedback suppression procedure prevents feedback from circling between the user station 50 and the remote telepresence unit 60 by decreasing a gain of the microphone pre-amps 342 in proportion to the signal that is being driven through the speakers 122. After the feedback suppression procedure, the local computer system 126 renders the audio data through the speakers 122. According to one embodiment of the present invention, steps 410–426 are executed continuously by the local computer system 126 and the remote telepresence unit 60 such that the sound field at the remote location can be recreated at the user station 50 in real-time.

Speak Through Remote Telepresence Unit Procedure

Figure 5B:
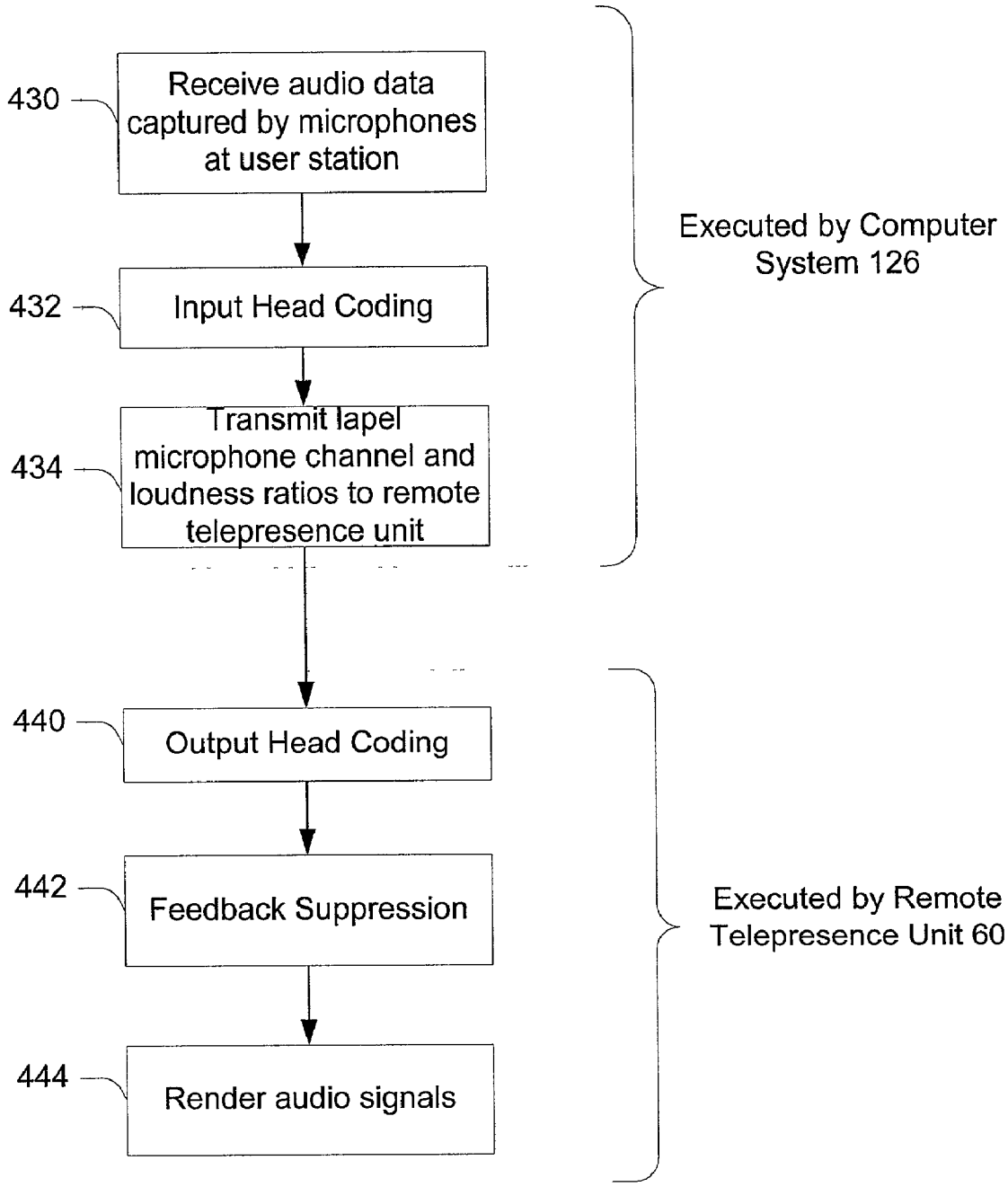
FIG. 5B is a flow diagram illustrating steps of a speak-via-remote-unit procedure in accordance with an embodiment of the present invention.

FIG. 5B is a flow diagram illustrating steps of a speak-via-remote-unit procedure in accordance with an embodiment of the present invention. Steps 430, 432, 434 are executed by the local computer system 126. Steps 440, 442, 444 are executed by the CPU 80 of the remote telepresence unit 60. In step 430, the local computer system 126 receives audio data captured by the microphones 236 and 237. In step 432, an input head coding procedure is executed. The input head coding procedure, which selects a lapel audio channel and calculates loudness ratios of the other audio channels relative to a loudest one, will be described in greater detail below. In step 434, the loudest audio channel and the loudness ratios are then sent to the remote telepresence unit 60 via communications medium 74.

In step 440, upon receiving the audio data from the local computer system 126, the CPU 80 of the remote telepresence unit 60 executes an output head coding procedure. The output head coding procedure, which reconstructs multiple audio channels from the received data, will be described in greater detail below. Then, in step 442, the CPU 80 executes the feedback suppression module 317. The feedback suppression procedure determines a gain of the microphone pre-amps 342 of the remote telepresence unit 60 such that sounds originated from the user location are not fed back through the directional microphones 112. After the gain of the pre-amps 342 is adjusted, the audio channels are rendered by the speakers 96 at the remote location. According to one embodiment of the present invention, steps 430–444 are executed continuously by the local computer system 126 and the remote telepresence unit 60 in parallel with steps 410–426 of FIG. 5A to create a full-duplex communication system.

Directional Steering of Audio Signals

Figure 7:
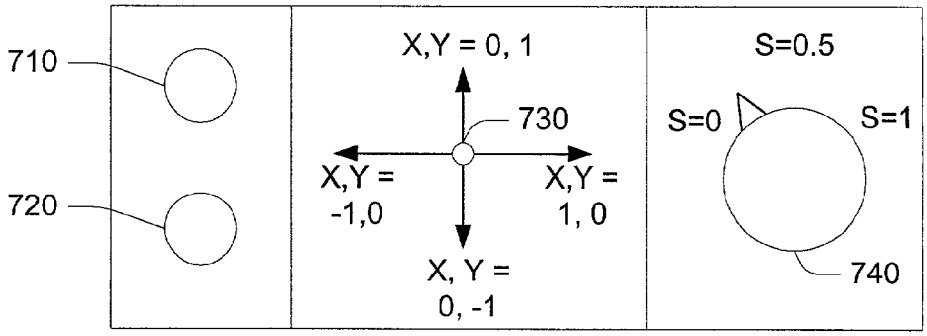
FIG. 7 is a diagram illustrating an implementation of the joystick control unit.

In one embodiment of the present invention, a user can steer his hearing with the use of the joystick control unit 234. FIG. 7 is a diagram illustrating a top view of one implementation of the joystick control unit 234. As shown, the unit includes a HOLD button 710, a HOLD-RELEASE button 720, a shaft 730 and a thrust-dial 740. The shaft 730, which can be moved to any position within the area 732, is used for adjusting the relative volume on different sides of the user. This has the effect of "steering" the hearing of the user. When the shaft 730 is moved to the left, the relative volume of the left side of the user will be correspondingly increased. When the shaft 730 is moved to the right, the relative volume of the right side of the user will be correspondingly increased. Likewise, when the shaft 730 is moved up and down, the relative volume of the front and rear channels will be correspondingly adjusted.

According to the present invention, the user can press the HOLD button 710 to lock in the X-Y position of the shaft 730. After the HOLD button is pushed, the shaft 730 can be moved without adjusting the volume on the different sides of the user. To release the lock on the joystick position, the user can press the HOLD-RELEASE button 720.

Also illustrated in FIG. 7 is a thrust-dial 740 for adjusting the gain of the audio channels. The thrust-dial 740, as shown, can be turned to any position between S=0 and a S=1. It should be appreciated that the joystick control unit, although described as being implemented in hardware, may be implemented in software in the form of a graphical user interface as well.

Figure 6:
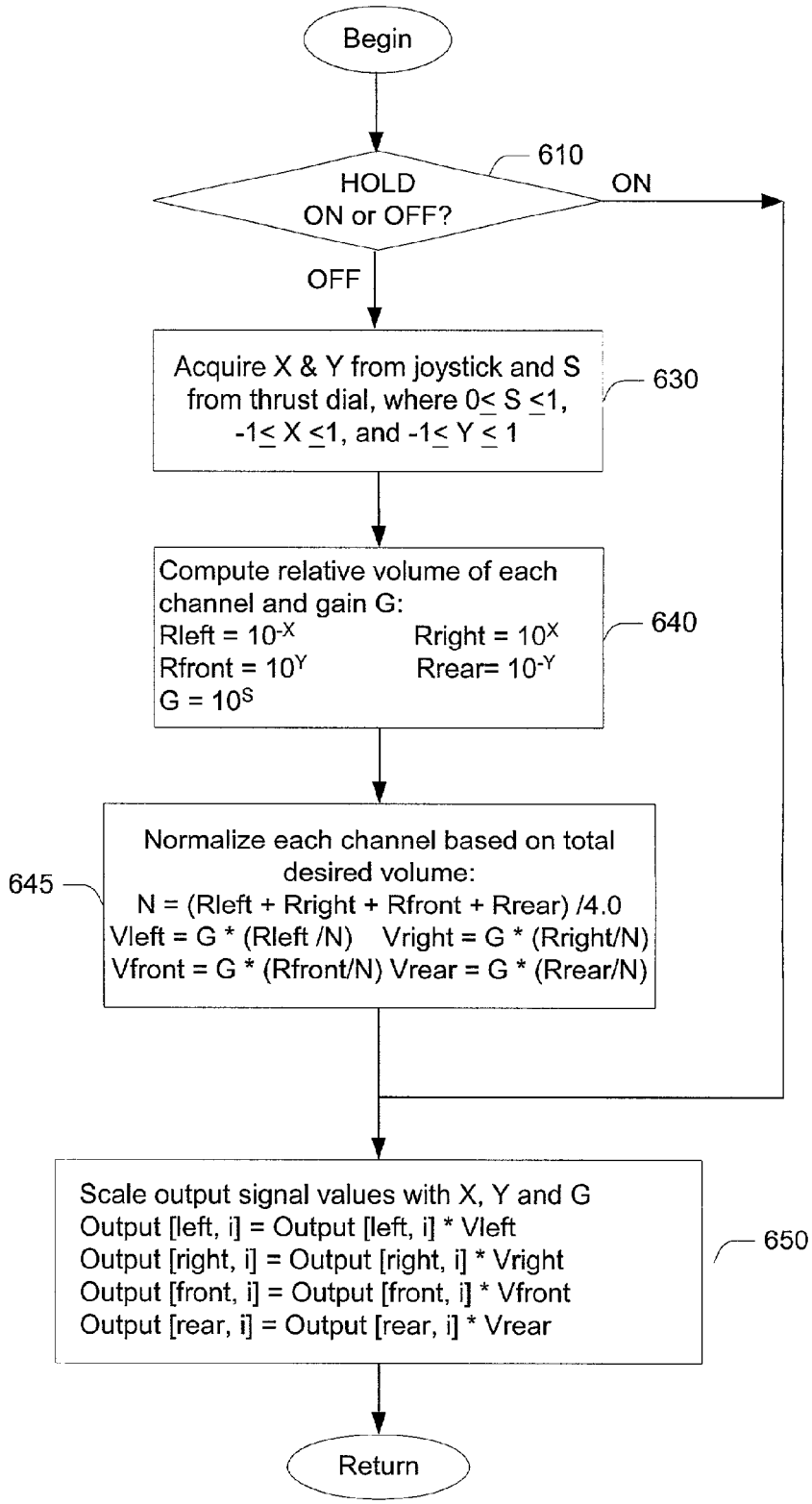
FIG. 6 is a flow diagram illustrating the steps of a directional steering procedure in accordance with an embodiment of the present invention.

FIG. 6 is a flow diagram illustrating the steps of a sound steering procedure in accordance with an embodiment of the present invention. The sound steering procedure is executed by the local computer system 126 and is described herein in conjunction with the joystick control unit 234 of FIG. 7. In the present embodiment, a variable value HOLD is used by the sound steering procedure to track the status of the HOLD button 710 and the HOLD-RELEASE button 720. The variable value HOLD is toggled to ON when the HOLD button 710 is pressed, and is toggled to OFF when the HOLD-RELEASE button 720 is pressed.

In step 610, the sound steering procedure checks whether the variable value HOLD is ON or OFF. If it is determined that HOLD is OFF, then the sound steering procedure acquires the X and Y position values from the joystick control unit 234, and the thrust-dial position value S from the thrust-dial 730 (step 630). Then, the relative volume of each of the left, right, front and rear channels is computed (step 640). As shown in FIG. 6, the relative volumes and the gain G are calculated by the following equations:

$$R\text{left}=10^{-X}$$

$$\text{Rright}=10^{X}$$

$$\text{Rfront}=10^{Y}$$

$$R\text{rear}=10^{-Y}$$

$$\text{G}=10^{S}.$$

Note that for a joystick setting of [0,0] (center), the relative volume of each channel is 1. If the joystick 730 is pushed to the far right, the right channel is ten times (or, 20 decibels) the normal volume and the left channel is a tenth (or −20 db) of the normal volume. Different bases may be used to get different relative volume effects. For example, using the square root of ten as a base will yield a maximum and minimum relative volume of +10 db and −10 db, respectively.

In step 645, the volume of each channel is normalized based on the total desired volume. In the present embodiment, the normalization is performed according to the following equations:

$$N=(R\text{left}+R\text{right}+R\text{front}+R\text{rear})/4.0$$

$$V\text{left}=G*(R\text{left}/N)$$

$$V\text{right}=G*(R\text{right}/N)$$

$$V\text{front}=G*(R\text{front}/N)$$

$$V\text{rear}=G*(R\text{rear}/N).$$

When the channels are normalized, the volume of the louder channel(s) will not be increased drastically. Rather, volume of the louder channel(s) is increased moderately, while the volumes of other channels are attenuated. In this way, the user will not be "blasted" by a sudden increase in channel volume from a particular audio channel.

In step 650, the left output channel is scaled by a factor of Vleft, the right output channel is scaled by a factor of Vright, the front output channel is scaled by a factor of Vfront, and the rear output channel is scaled by a factor of Vrear. Thereafter, the sound steering procedure ends. The scaling is preferably repeated once every 0.1 second. <<?

If it is determined that the HOLD state is ON, then previously acquired joystick position settings X, Y and S should be used. Steps 630–650 can be skipped and the output signals are scaled with previously determined Vleft, Vright, Vfront and Vrear values (Step 650).

Feedback Suppression

Figure 8:
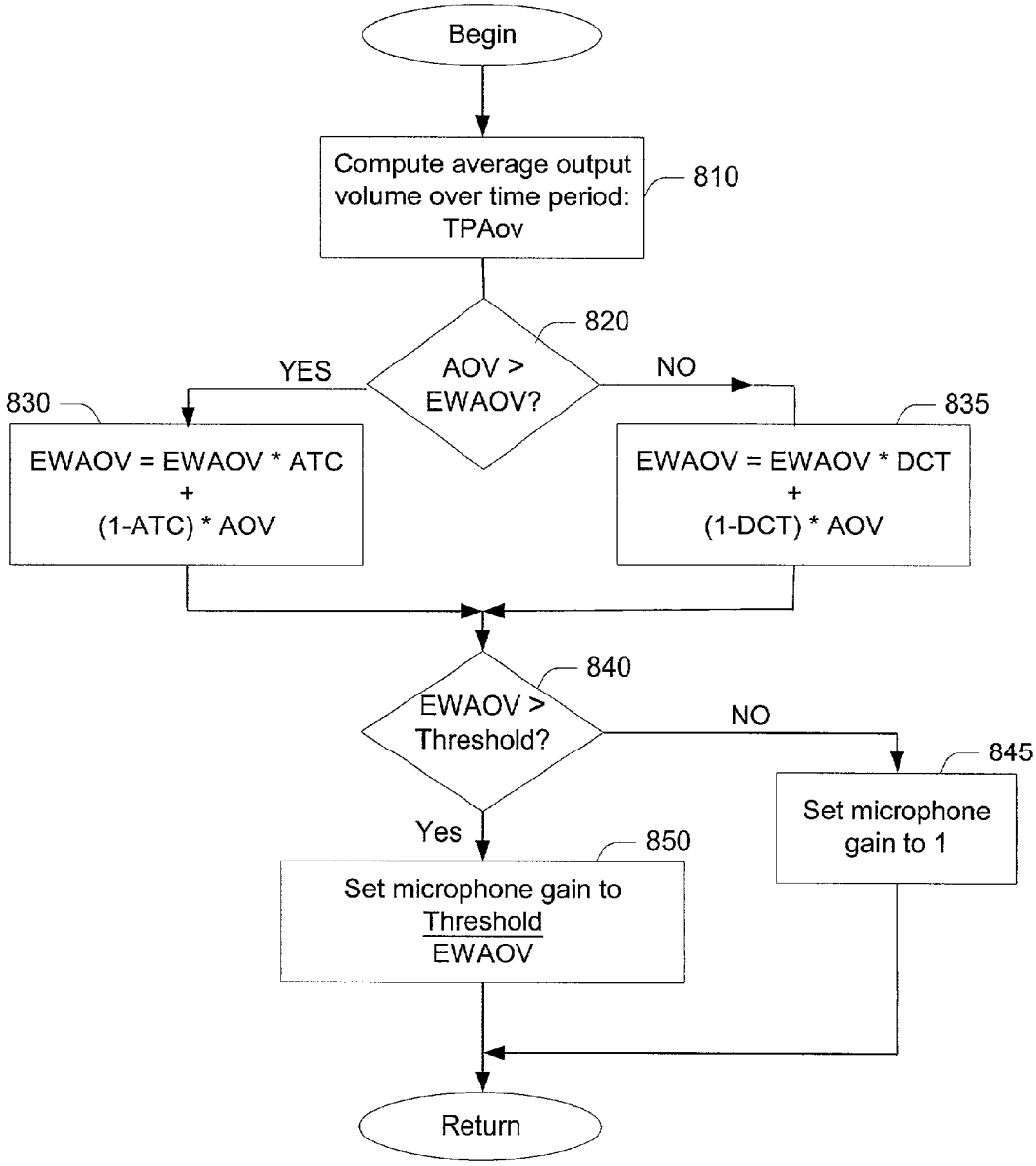
FIG. 8 is a flow diagram illustrating the operations of a feedback suppression procedure in accordance with an embodiment of the present invention.

FIG. 8 is a flow diagram illustrating the operations of a feedback suppression procedure in accordance with an embodiment of the present invention. The feedback suppression procedure, in the present embodiment, may be executed as part of the speak-via-remote telepresence unit procedure and/or as part of the listen-via-remote telepresence unit procedure.

As shown in FIG. 8, in step 810, the feedback suppression procedure computes an average output volume (AOV) of the speakers 122 over a time period. Then, at step 820, AOV is compared against an Exponential Weighted Average Output Volume (EWAOV) in step 820. The value of EWAOV is assumed to be zero initially. If the AOV is larger than EWAOV, in step 830, the feedback suppression procedure recalculates EWAOV by the equation:

$$EWAOV=EWAOV*ATC+(1-ATC)*AOV$$

where ATC is the attack time constant. In the present embodiment, ATC is set to be 0.8. In step 835, if the AOV is smaller than EWAOV, the feedback suppression procedure recalcualtes EWAOV by the equation:

$$EWAOV=EWAOV*DCT+(1-DCT)*AOV$$

where DCT is the decay time constant. In the present embodiment, DCT is set to be 0.95.

After EWAOV is recalculated, the feedback suppression procedure compares EWAOV against a threshold value (step 840). The threshold value depends on many variable factors such as the size of the room in which the remote telepresence unit 60 is located, the transmission delay between the user station 50 and the remote telepresence unit 60, etc., and should be fine-tuned on a "per use" basis. In step 850, if EWAOV is larger than the threshold value, the gain G of the microphone pre-amps 342 is set to:

$$G=\frac{Threshold}{EWAOV}$$

If EWAOV is smaller than or equal to the threshold value, the gain G of the microphone pre-amps 342 is set to one (step 845).

Thereafter, the feedback suppression procedure ends. Note that the feedback suppression procedure is executed periodically at approximately once per forty milliseconds. Also note that there are many ways of performing feedback suppression, and that many well known feedback suppression methods may be used in place of the procedure of FIG. 8.

Efficient Audio Compression for a Directional Head

In accordance one embodiment of the present invention, at the user station 50, there are at least four directional microphones 236 used to acquire the user's voice from four different directions (e.g., front, back, left, and right). The remote telepresence unit 60 has a set of at least four speakers 96, each corresponding to one of the directional microphones 236. This allows the user to project their voice more strongly in certain directions than others. Most people are familiar with the concept that they should speak facing the audience instead of facing a projection screen or the stage. Having a multiplicity of speakers to output the user's voice preserves this capability. Similarly, if the virtual location of the user at the remote location is in a crowd of people, they may wish their voice to be heard predominantly in a specific direction.

Note that in open-field conditions (without nearby reflecting surfaces) the audio volume in front of a person speaking is 20 db greater at a given distance in front of a person's head compared to the same distance behind that person's head. By having multiple channels from the user to the remote location we can choose to either preserve this effect, or to enable under user control the capability of talking out of more than one side of the remote telepresence unit 60's head (e.g, display 84) at the same time.

Because the system is designed around a single user, there is no actual need to send four independent voice channels from the user to the remote telepresence unit 60. In order to save bandwidth, in one embodiment, the contents of the loudest voice channel are sent along with a set of vectors giving the relative volume in each channel. The volume vectors only need to be updated approximately every one hundred milliseconds (i.e., a 10 Hz sampling rate) to capture the effects of any positional changes or rotation of the user's head. In comparison, high-quality audio channels may be sampled from 12 KHz up to 48 KHz (CD-quality) or higher. This effectively saves 75% of the bandwidth required to send 4 independent audio channels from the user to the remote location.

The tonal qualities of spoken audio in front of a user also differ from those of audio from behind a user's bead. In particular, higher frequencies are attenuated more steeply behind a user's head than lower frequencies. In one embodiment, besides just lowering the volume of the loudest channel by the amount specified by the transmitted vector, we can equalize the output of the other channels. This equalization is based on typical characteristics of audio frequency attenuation at various angles around a sample of user's heads, inferred from the relative volume vectors.

Figure 9:
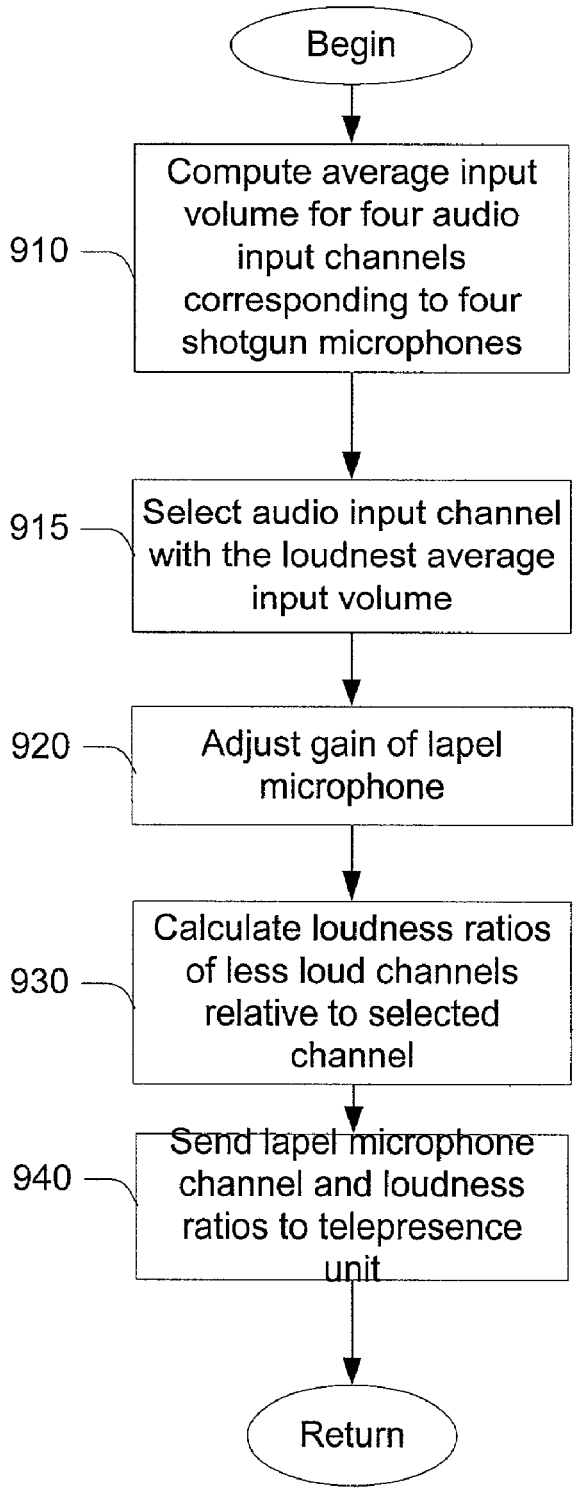
FIG. 9 is a flow diagram illustrating an input head coding procedure according to an embodiment of the invention.
Figure 10:
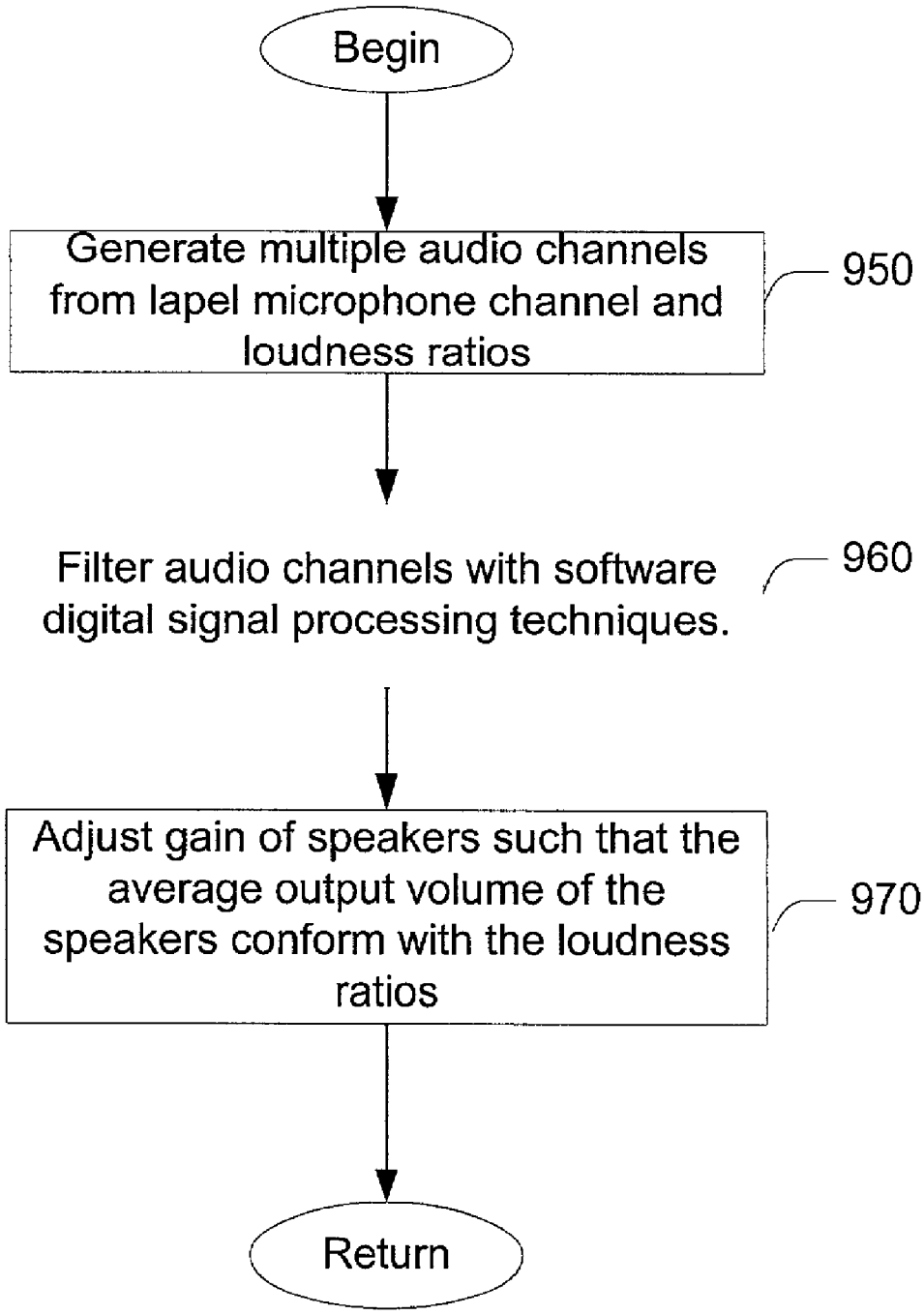
FIG. 10 is a flow diagram illustrating an output head coding procedure according to an embodiment of the present invention.

FIGS. 9 and 10, respectively, illustrate an input head coding procedure and an output head coding procedure in accordance with an embodiment of the present invention. Note that the head coding procedures are called by the speak-via-remote telepresence unit module 314. The input head coding procedure is executed by the local computer system 126 at the user station 50, and the output head coding procedure can be executed by the CPU 80 of the remote telepresence unit 60.

As shown, in step 910, the average input volumes of four audio input channels (from four shotgun microphones 236 at user station 50) is computed. In step 915, one of the four audio input channels with the highest average input volume is selected. Then, at step 920, the gain of the lapel microphone 237 is adjusted such that its average input volume is close to that of the selected channel. In step 930, the loudness ratios of the average input volumes corresponding to the four shotgun microphones 236 relative to the average input volume of the selected channel are computed. Then, in step 940, audio data corresponding to the lapel microphone 237 and the loudness ratios are sent to the remote telepresence unit 60.

As an example, assume that the front microphone facing the user is has a highest average input volume, and that the rear microphone facing the back of the user's head has an average input volume that is 1/100th of that of the front channel. Further assume that the side channels have average input volumes that are 1/10th of that of the front channel. In this particular example, the gain of the lapel microphone 237 is adjusted such that its average input volume is approximately the same as that of the front channel. The audio channel of the lapel microphone 237 and the loudness ratios are then sent to the remote telepresence unit 60.

Figure 11:
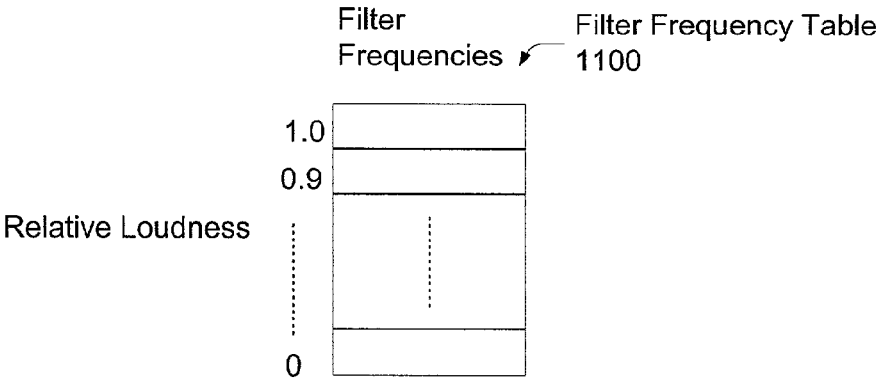
FIG. 11 depicts an exemplary filter table according to an embodiment of the invention.

Attention now turns to FIG. 10. In step 950, upon receiving data corresponding to the lapel microphone channel and loudness ratios, the remote telepresence unit 60 reconstructs four audio channels from the received data. Then, in step 960, the audio channels are filtered based using software digital signal processing techniques. In the present embodiment, the software filters depend on the loudness ratio and a filter table. An exemplary filter table is shown in FIG. 11. The filter table 1100 has a plurality of entries for storing pre-determined cut-off frequencies in association with the loudness ratio. The filter table 1100 can be used to reproduce the change in sound timbre which is dependent on the angle of the speaking person's head relative to the listener. At angles further away from the front, higher frequencies are attenuated. The filter table 1100 can model this effect by assigning different filter frequencies with different comer points and slopes to audio channels of different relative loudness. The relative loudness is used as an approximation for the head angle such that less loud channels then will have more of their high-frequency content filtered out. Note that step 960 is optional.

In step 970, the audio output channels are scaled such that the average output volume of each channel conforms with the loudness ratios. By using the head-coding procedure of the present invention, the user can control the direction at which the telepresence unit 60 will project his voice without consuming a significant amount of data transmission bandwidth.

Alternate Embodiments

The foregoing descriptions of specific embodiments of the present invention are presented for purposes of illustration and description. They are not intended to be exhaustive or to limit the invention to the precise forms disclosed. Rather, it should be appreciated that many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An audio telepresence system, comprising:

a user station at a first location, the user station comprising:

a plurality of microphones adapted to be positioned around a user to capture sound produced by the user; and a lapel microphone for capturing the sound produced by the user;

the user station comprising a computer system configured to:

compare input volumes for each of the plurality of microphones to determine directional information associated with the sound produced by the user based on which one of the plurality of microphones has the highest input volume; and generate a stream of data representative of sound captured by at least one of the plurality of microphones, the lapel microphone, or both; and a telepresence unit at a second location, the telepresence unit providing a three-dimensional representation of the user that simultaneously includes a front view and a profile view, the telepresence unit being remotely coupled to the user station to receive the stream of data and the directional information, the telepresence unit comprising a plurality of speakers for projecting sound interpreted from the stream of data in a direction corresponding to the directional information, the telepresence unit being further adapted to capture audio stimuli at the second location and to communicate the audio stimuli to the user station.

2. The audio telepresence system of claim 1, wherein the plurality of microphones each correspond to one of the plurality of screens of the telepresence unit.

3. The audio telepresnece of system of claim 1, wherein the directional information comprises loudness ratios of each of the plurality of microphones relative to a selected one of the plurality of microphones.

4. The audio telepresence system, of claim 1, wherein the telepresence unit includes a computer system for reconstructing a plurality of audio channels from the stream of data and the directional information, the plurality of audio channels each for rendering by one of the plurality of speakers.

5. The audio telepresence system of claim 1, wherein the computer system is configured to adjust a gain of the lapel microphone to approximate that of the one of the plurality of microphones that has the highest input volume.

6. The audio telepresence system of claim 1, wherein the plurality of speakers includes at least one speaker corresponding to each of the plurality of microphones.

7. The audio telepresence system of claim 1, wherein the plurality of speakers includes at least four speakers arranged with respect to an initial user position.

8. The audio telepresence system of claim 7, wherein the at least four speakers include a forward speaker, a rearward speaker, a left speaker, and a right speaker.

9. The audio telepresence system of claim 1, wherein the plurality of microphones includes at least four microphones arranged with respect to an initial user position.

10. The audio telepresence system of claim 9, wherein the at least four microphones include a front microphone, a back microphone, a left microphone, and a right microphone.

11. A method of recreating communication at a first location at a second location, comprising:

capturing sound at the first location, comprising:

capturing the sound at a plurality of positions around a user site with a plurality of fixed microphones;

capturing the sound with a portable microphone;

determining loudness values for sound captured by each of the plurality of fixed microphones;

comparing the loudness values for each of the plurality of fixed microphones;

determining a primary microphone of the plurality of fixed microphones based on the comparison of the loudness values for each of the plurality of fixed microphones;

converting the sound captured by the portable microphone into audio data;

transmitting the audio data to a telepresence unit at the second location; and projecting the captured sound at the second location, comprising:

playing the audio data at a different volume at each of a plurality of speakers of the telepresence unit based a correspondence between each of the plurality of speakers, the plurality of fixed microphones, and the loudness values associated with the plurality of fixed microphones.

12. The method of claim 11, comprising transmitting a three-dimensional video representation to the telepresence unit, wherein the three-dimensional video representation simultaneously includes a front view and a profile view.

13. The method of claim 12, wherein the three-dimensional video representation simultaneously includes a rear view.

14. The method of claim 11, comprising recording video data at the first location with a plurality of video cameras positioned around the user site.

15. The method of claim 11, wherein the loudness values include loudness ratios of average input volumes for each of the plurality of fixed microphones.

16. The method of claim 11, comprising adjusting a gain of the portable microphone such that its average input volume is substantially equivalent to that of the primary microphone.

17. The method of claim 11, comprising conserving transmission bandwidth by only transmitting an audio channel of the portable microphone and loudness values for the plurality of fixed microphones as the audio data.

18. A telepresence system, comprising:

a user station, comprising:

at least four directional microphones positioned in a substantially horizontal plane around a user site;

a lapel microphone;

a local computer configured to determine input volume values associated with each of the at least four directional microphones and select a primary microphone of the at least four directional microphones based on a comparison of the input volume values;

a transmission unit configured to transmit a data stream including sound captured by the lapel microphone and loudness values to a remote telepresence unit; and the remote telepresence unit, comprising:

a receptor configured to receive the data stream;

at least four speakers, wherein each of the four speakers corresponds to one of the four directional microphones; and a processing unit configure to reconstruct the data stream into at least four audio channels and submit each of the at least four audio channels to a different one of the at least four speakers based on the loudness values.

19. The system of claim 18, wherein the local computer is configured to adjust a gain of the lapel microphone to substantially equal the loudness values of the primary microphone.

20. The system of claim 18, wherein the telepresence unit includes a plurality of remote microphones.

21. The system of claim 18, wherein the user station comprises a plurality of cameras positions in a substantially horizontal plane around the user site.

22. The system of claim 21, wherein the remote telepresence unit comprises a plurality of screens, wherein each of the plurality of screens corresponds to at least one of the plurality of cameras.

23. The system of claim 18, wherein the user station comprises a plurality of local speakers corresponding to the plurality of remote microphones.

24. The system of claim 23, wherein the user station comprises a sound steering unit configured to facilitate selection of relative loudness of the sound received from each of the plurality of remote microphones.

25. The system of claim 23, wherein the plurality of local speakers include at least twelve local speakers arranged in two stacked rings disposed about the user cite.

* * * * *

UNITED STATES PATENT AND TRADEMARK OFFICE

CERTIFICATE OF CORRECTION

PATENT NO. : 7,184,559 B2
APPLICATION NO. : 09/792489
DATED : February 27, 2007
INVENTOR(S) : Norman P. Jouppi It is certified that error appears in the above-identified patent and that said Letters Patent is hereby corrected as shown below:

In column 3, line 41, after “of” delete “15”.

In column 10, line 65, delete “bead” and insert -- head --, therefor.

In column 11, line 55, delete “comer” and insert -- corner --, therefor.

In column 12, line 48, in Claim 3, delete “telepresnece of” and insert -- telepresence --, therefor.

In column 12, line 52, in Claim 4, delete “system,” and insert -- system --, therefor.

In column 14, line 51, in Claim 25, delete “cite” and insert -- site --, therefor.

Signed and Sealed this

Thirtieth Day of June, 2009

JOHN DOLL
*Acting Director of the United States Patent and Trademark Office*